US007380541B1

(12) United States Patent
Ricco et al.

(10) Patent No.: US 7,380,541 B1
(45) Date of Patent: Jun. 3, 2008

(54) FUEL-INJECTION SYSTEM FOR AN INTERNAL-COMBUSTION ENGINE

(75) Inventors: Mario Ricco, Casamassima (IT); Raffaele Ricco, Valenzano (IT); Sergio Stucchi, Valenzano (IT); Onofrio De Michele, Valenzano (IT); Antonio Gravina, Valenzano (IT); Domenico Lepore, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 0 days.

(21) Appl. No.: 11/619,967

(22) Filed: Jan. 4, 2007

(30) Foreign Application Priority Data

Nov. 16, 2006 (EP) ..... 06425781

(51) Int. Cl.
*F02M 37/06* (2006.01)

(52) U.S. Cl. ..... 123/447; 123/459; 123/506; 123/508; 123/514

(58) Field of Classification Search ..... 123/447, 123/459, 506, 508, 514
See application file for complete search history.

(56) References Cited

U.S. PATENT DOCUMENTS

| | | | | |
|---|---|---|---|---|
| 4,554,903 | A * | 11/1985 | Straubel et al. | 123/575 |
| 4,662,825 | A * | 5/1987 | Djordjevic | 417/206 |
| 4,920,940 | A * | 5/1990 | Harris et al. | 123/450 |
| 5,133,645 | A * | 7/1992 | Crowley et al. | 417/279 |
| 6,516,784 | B1 | 2/2003 | Shingu | |
| 6,966,300 | B2 * | 11/2005 | Fukuda | 123/446 |
| 7,171,944 | B1 * | 2/2007 | Oono | 123/357 |

FOREIGN PATENT DOCUMENTS

| | | |
|---|---|---|
| DE | 19858084 | 4/2000 |
| EP | 1674716 | 6/2006 |
| EP | 1674718 | 6/2006 |
| WO | WO 03/091566 | 11/2003 |
| WO | WO 2004/036034 | 4/2004 |

OTHER PUBLICATIONS

European Search Report for European Patent Application No. 06425781.9, mailed Apr. 26, 2007.

* cited by examiner

*Primary Examiner*—Erick Solis
(74) *Attorney, Agent, or Firm*—Sheridan Ross P.C.

(57) ABSTRACT

The injection system comprises a high-pressure pump with variable flowrate, having at least one pumping element provided with an intake valve in communication with an intake pipe and a delivery valve in communication with a delivery pipe. A pressure regulator is set on the intake pipe downstream of a metering solenoid valve designed to meter the flowrate of the pump according to the operating conditions of the engine. The pressure regulator is designed to discharge the excess fuel into a compartment of a crankcase for lubricating the usual actuation mechanism of the pumping element. Set between an inlet of the solenoid valve and an inlet of the pressure regulator is a control volume designed to contain an amount of fuel such as to guarantee an adequate flow of fuel in an area corresponding to the inlet of the solenoid valve.

7 Claims, 2 Drawing Sheets

FUEL-INJECTION SYSTEM FOR AN INTERNAL-COMBUSTION ENGINE

The present invention relates to an improvement to a fuel-injection system for an internal-combustion engine, comprising a high-pressure pump with variable delivery or flowrate having at least one pumping element actuated with reciprocating motion.

In known high-pressure pumps of the aforesaid type, the flowrate of the pump must be adjusted according to the operating conditions of the engine so as to prevent fuel in excess from being sent to the usual common rail for supply of the injectors and reducing in this way the work absorbed by the high-pressure pump. In general, the pump of the aforesaid type is supplied with fuel by a low-pressure pump, which, for economic reasons, is in general an electric pump supplied with constant voltage and hence delivers a constant flowrate of fuel. Said electric pump is sized in such a way that the constant flowrate delivered is equal to the maximum flowrate required (sum of the flowrate of the fuel introduced into the engine cylinders by the injectors in conditions of maximum load plus the flowrate corresponding to actuation of said injectors plus the flowrate necessary for lubricating the crankcase of the pump in the same conditions) multiplied by an appropriate safety coefficient higher than 1. In addition, the high-pressure pump comprises an actuation mechanism enclosed in a crankcase, which is lubricated and cooled by a flowrate of fuel that is subtracted from the flowrate supplied by the low-pressure electric pump.

In a known injection system, it has been proposed to dose the flowrate of the high-pressure pump by means of a shut-off solenoid valve arranged on the usual intake pipe and controlled by a control unit. There is consequently evident the need for a purposely provided pressure regulator set on the intake pipe of the pumping elements of the high-pressure pump, which, by discharging the possible excess fuel into the tank, is able to maintain the pressure of the fuel upstream of the shut-off solenoid valve at a constant value. In this way, since the shut-off valve works between two almost constant pressure levels, by controlling the times of opening thereof (in addition to the intervention rate) it is possible to dose the amount of fuel sent to the intake valves of the pumping elements. In this way, the high-pressure pump takes in only the fuel to be compressed, required by the operating conditions of the engine. The solenoid valve thus remains closed for longer periods when the engine works at low levels of r.p.m., since it requires a smaller amount of fuel. Instead, at low engine r.p.m., the pressure regulator must dispose of a larger amount of fuel (i.e., the complement of the one supplied by the low-pressure electric pump) towards the crankcase.

In the aforesaid known system, the shut-off solenoid valve is arranged on the intake pipe of the pump, downstream of the pressure regulator, so that, when the solenoid valve is closed, in the stretch of intake pipe between the inlet of the pressure regulator and the solenoid valve, the flow of fuel stops. When the solenoid valve opens again, the flow of fuel in said stretch must start to move again starting from a stationary condition thus giving rise to a certain histheresis, so that the effect of re-opening of the solenoid valve is delayed and disturbed.

The aim of the invention is to provide a fuel-injection system of high reliability and limited cost, eliminating the drawbacks of injection systems according to the known art.

According to the invention, the above aim is achieved by a fuel-injection system as defined by claim 1.

In particular, the pressure regulator is set in the intake pipe of the high-pressure pump upstream of the metering solenoid valve, whilst set between an inlet of the solenoid valve and an inlet of the pressure regulator is a control volume designed to guarantee, in an area corresponding to the inlet of the solenoid valve, a flow of fuel having a pre-set flowrate and/or speed.

For a better understanding of the invention a preferred embodiment thereof is described herein, purely by way of example with the aid of the annexed drawings, wherein.

Figure 1:
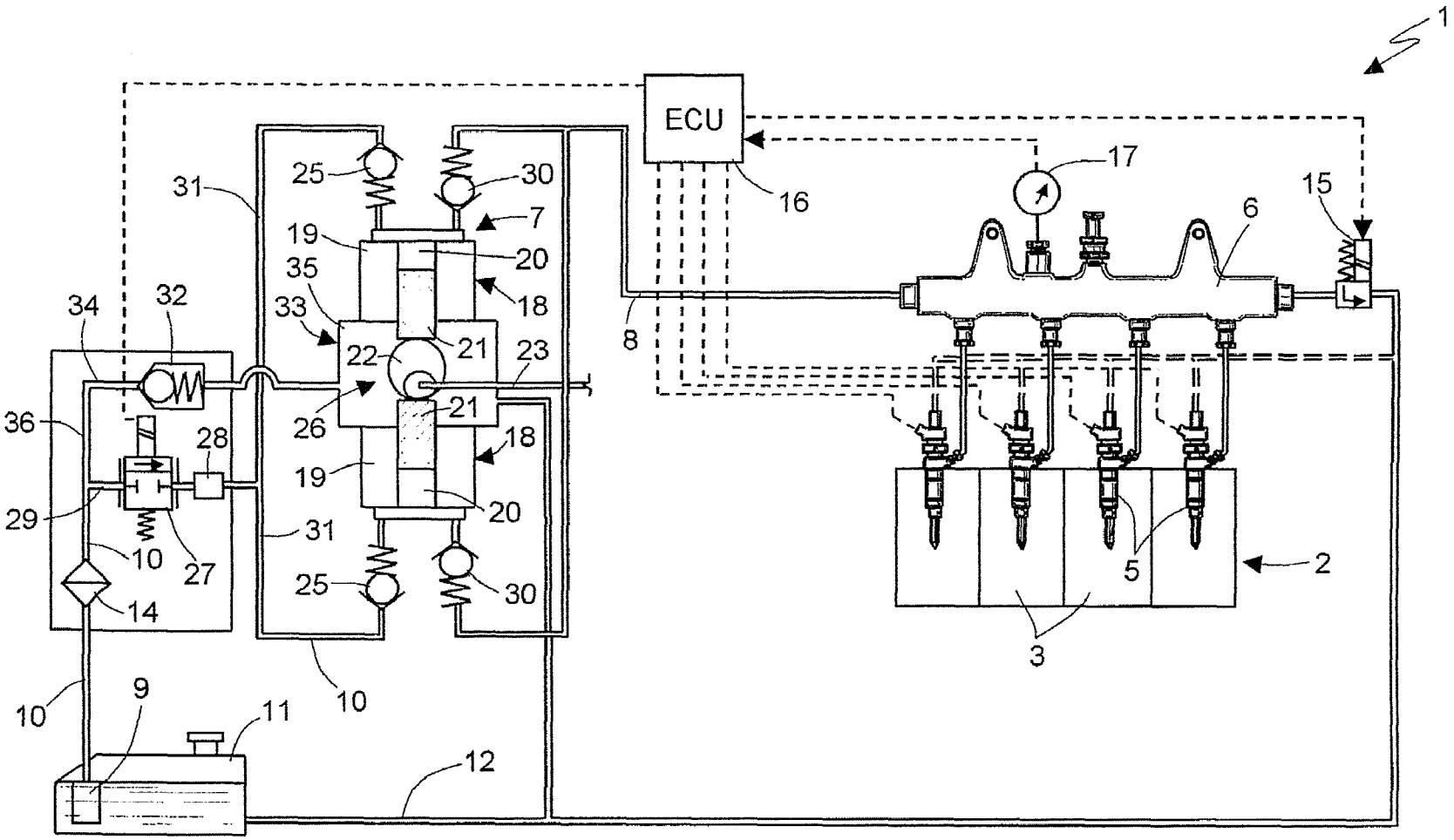
FIG. 1 is a diagram of a fuel-injection system according to the invention.

With reference to FIG. 1, designated as a whole by 1 is a fuel-injection system for an internal-combustion engine 2, for example a four-stroke diesel engine. The engine 2 comprises a plurality of cylinders 3, for example four cylinders. The injection system 1 comprises a plurality of electrically controlled injectors 5, associated to the cylinders 3 and designed to inject the fuel at a high pressure therein. The injectors 5 are connected to an accumulation volume for the pressurized fuel, for example, formed by the usual common rail 6, connected to which are all the injectors 5.

The common rail 6 is supplied with fuel at high pressure by a high-pressure pump, designated as a whole by 7, via a delivery pipe 8. In turn, the high-pressure pump 7 is supplied by a low-pressure pump, for example, an electric pump 9, via an intake pipe 10 of the pump 7. The electric pump 9 is in general located in the usual fuel tank 11, giving out into which is a discharge pipe 12 for the excess fuel of the injection system 1. Set on the intake pipe 10 is a filter 14 designed to prevent any possible impurities present in the fuel pumped by the low-pressure pump 9 from entering the pump 7.

Each injector 5 is designed to inject, into the corresponding cylinder 3, an amount of fuel that is variable between a minimum value and a maximum value under the control of an electronic control unit 16, which can be constituted by the usual microprocessor control unit for control of the engine 2. The control unit 16 is designed to receive signals indicating the operating conditions of the engine 2, generated by corresponding sensors (not shown), as well as the pressure of the fuel in the common rail 6, detected by a pressure sensor 17.

The control unit 16, by processing the signals received by means of a purposely provided program, controls the instant and duration of the actuation of the individual injectors 5. Consequently, the discharge pipe 12 conveys the discharge fuel of the injectors 5 into the tank 11.

The high-pressure pump 7 comprises at least one pumping element 18 formed by a cylinder 19 having an intake/compression chamber 20, sliding in which is a piston 21 which is movable with reciprocating motion between an intake stroke and a delivery stroke. In particular, in FIG. 1 the pump 7 comprises two pumping elements 18, each having an intake/compression chamber 20 provided with a corresponding intake valve 25 and a corresponding delivery valve 30. The valves 25 and 30 can be of the ball type and can be provided with respective return springs. The two intake valves 25 are in communication with the intake pipe 10 common thereto, whilst the two delivery valves 30 are in communication with the delivery pipe 8 common to the latter.

The pistons 21 are actuated by an actuation mechanism 26 housed in a compartment 35 enclosed in a crankcase 33. In the variant of FIG. 1, the two pumping elements 18 are coaxial and opposite to one another, i.e., are in line with respect to one another, and the actuation mechanism comprises just one eccentric cam 22 carried by a shaft 23 so that the pumping elements are actuated with a phase offset with respect to one another of 180°. The shaft 23 can be actuated in any known way, for example by the usual shaft engine 2 via a motion-transmission device.

The flowrate of the pump 7 is controlled exclusively by a metering or shut-off solenoid valve 27, of the on-off type, which is provided with an inlet 29 in communication with the intake pipe 10 and is in communication at outlet with the intake valves 25. The solenoid valve 27 is designed to be actuated, in a synchronous or asynchronous way with respect to the intake stroke of the pumping elements 18, by the electronic control unit 16 according to the operating conditions of the engine 2, by means of control signals modulated in frequency and/or duty cycle.

In particular, the outlet of the solenoid valve 27 is in communication with another accumulation volume, designated as a whole by 28, for accumulating the fuel that must be taken in by the two pumping elements 18. The accumulation volume 28 is in turn in communication with the intake valves through two stretches 31 of the intake pipe 10. The accumulation volume 28 is designed to contain an amount of fuel to be taken in such as to enable supply of each pumping element 18 during a variable part of the corresponding intake stroke, depending upon the operating conditions of the engine 2. Said accumulation volume 28 can also be constituted by one or more stretches of the intake pipe 10 downstream of the solenoid valve 27 or else can be integrated with said stretches of pipe 10.

The operating conditions of the engine 2 determine the amount of fuel that the pump 7 must take in through the pipe 10, maintaining an adequate pressure of said fuel in the accumulation volume 28. Control of the solenoid valve 27 is performed in a way that is synchronous or asynchronous with respect to the intake stroke of each pumping element 18 on the basis of the operating conditions of the engine. Advantageously, said control is performed both during the intake stroke and during the stroke of compression of the piston 21 of each pumping element 18. In particular, the control operates asynchronously with the intake stroke of the pumping elements 18 in the case of partialization at low engine r.p.m. with an actuation rate such as to prevent the open/close element of the solenoid valve 27 from operating with ballistic motion.

Set moreover on the intake pipe 10 is a pressure regulator 32, which has the purpose of maintaining constant the pressure of the fuel to be taken in pumped continuously by the low-pressure pump 9. In particular, the pressure regulator 32 is provided with an inlet 34 in communication with the intake pipe 10. The regulator 32 sends the excess fuel into the crankcase 33 of the pump 7, in order to cool and lubricate the entire actuation mechanism 26 contained in the crankcase 33. The fuel of the crankcase 33 then returns to the tank 11, through the pipe 12.

The solenoid valve 27 has a relatively reduced effective section of passage so as to enable metering of the fuel before it is brought to a high pressure by the pump 7. Preferably, said section of passage is such that, as a result of the difference between the pressure upstream and the pressure downstream of said section of passage (in particular, the pressure upstream is defined by the pressure regulator 32), the solenoid valve 27 presents a maximum instantaneous flowrate smaller than the maximum instantaneous flowrate that can be taken in through the intake valve 25. The maximum instantaneous flowrate of the solenoid valve 27 can be as far as 10% less than the maximum instantaneous flowrate of the intake valve 25.

In the tank 11, the fuel is at atmospheric pressure. In use, the electric pump 9 compresses the fuel to low pressure, for example in the region of just 3-5 bar. In turn, the high-pressure pump 7 compresses the fuel metered by the solenoid valve 27 so as to send, via the delivery pipe 8, the fuel at high pressure, for example in the region of 1600 bar, to the pressurized fuel common rail 6. Consequently, the solenoid valve 27 must frequently close and re-open the intake pipe 10. However, the low-pressure pump 9 must have a flowrate such as to guarantee both the circulation of the fuel in the crankcase 33 and the maximum amount of fuel that can be required by the cylinders 3 of the engine 2.

According to the invention, the pressure regulator 32 is set on the intake pipe 10 downstream of the solenoid valve 27, preferably separated by a stretch 36 of the intake pipe 10, having a pre-set volume. In this way, the pressure regulator 32 sends continuously a certain amount of fuel into the crankcase 33 so that in the branching between the pipe 10 and the inlet 29 of the solenoid valve 27 there is always a certain flow of fuel. At the moment when the solenoid valve 27 is re-opened, in the stretch 36 of pipe 10 comprised between the inlet 29 of the solenoid valve 27 and the inlet 34 of the pressure regulator 32, there exists a certain flow of fuel so that the fuel has a certain kinetic component and passes extremely promptly through the inlet 29 of the solenoid valve 27. Obviously, the volume of the stretch 36 must be chosen so as to guarantee in an area corresponding to the inlet 29 of the solenoid valve 27 a flow having a pre-set flowrate or speed, without interrupting the flow of fuel that the pressure regulator 32 sends to the crankcase 33.

Figures 2, 3, 4:
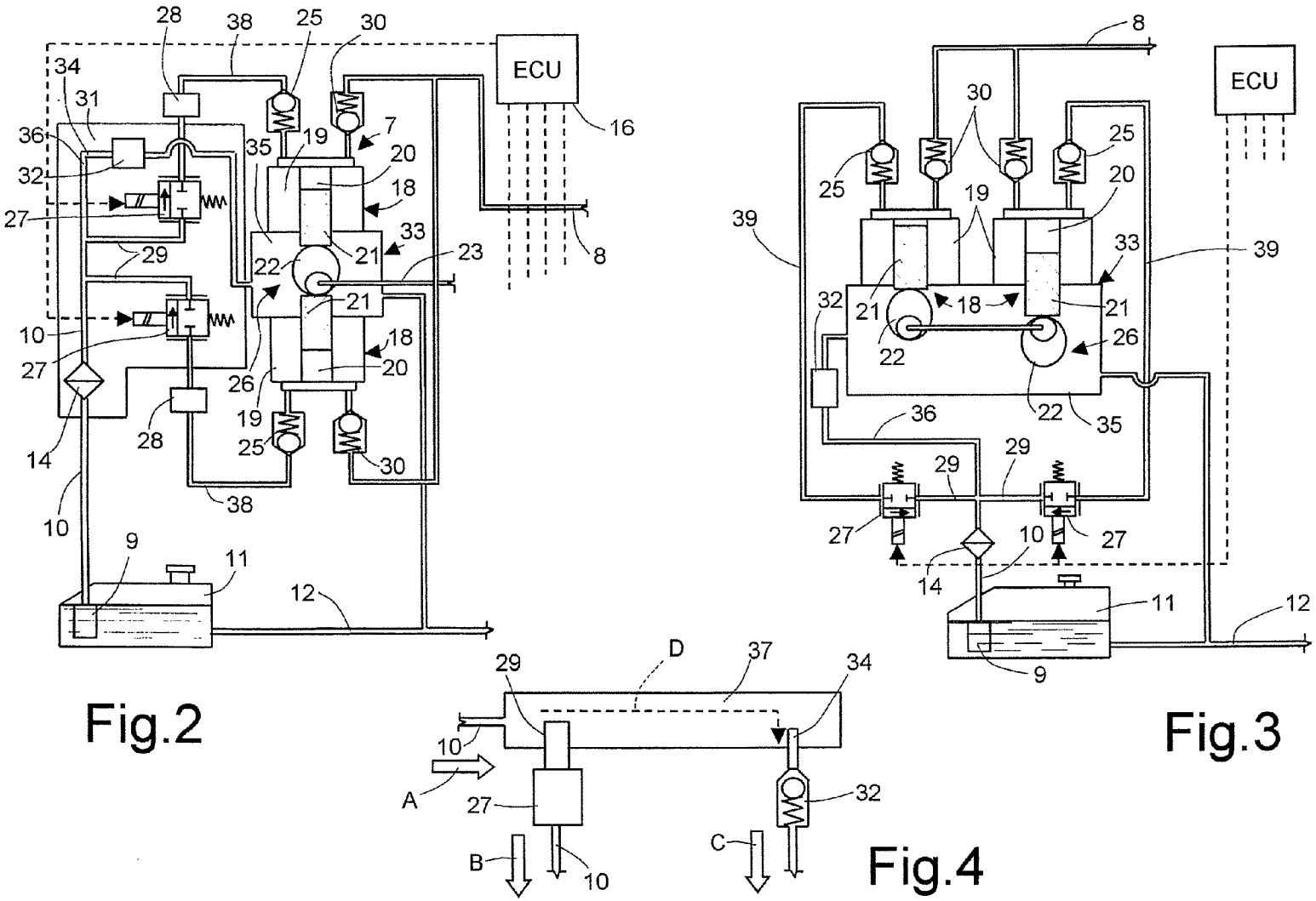
FIGS. 2 and 3 are two partial diagrams of two variants of the invention.
FIG. 4 is a diagram of a detail of the system according to another variant of the invention.

According to the variant of FIG. 2, the flowrate of the two pumping elements 18 is metered by two corresponding shut-off solenoid valves 27 associated to two corresponding accumulation volumes 28, which are in communication with the respective intake valves via two corresponding stretches 38 of the intake pipe 10. The two solenoid valves 27 have a relevant inlet 29, which is set on the pipe 10 upstream of the inlet 34 of the pressure regulator 32, thus forming the intermediate stretch 36 of the pipe 10.

According to the variant of FIG. 3, the two pumping elements 18 are set alongside one another and are actuated by two eccentric cams 22 fitted on the shaft 23, 180° out of phase with respect to one another. Also in this case the flowrate of the two pumping elements 18 is metered by two corresponding shut-off solenoid valves 27, which are in direct communication with the corresponding intake valves 25 via two stretches 39 of the intake pipe 10. The two solenoid valves 27 have two corresponding inlets 29 set upstream of the inlet 34 of the regulator 32, forming also in this case the intermediate stretch 36 of the pipe 10.

According to the variant of FIG. 4, a control volume 37 having a cross section different from the one of the intake pipe 10 can be set between the inlet 29 of the solenoid valve 27 and the inlet 34 of the pressure regulator 32. However, the amount of fuel that the control volume 37 must contain must be such as to guarantee a sufficient flow of fuel in an area corresponding to the inlet 29 of each solenoid valve 27.

In FIG. 4, the arrow A indicates the flow of fuel coming from the filter 14, the arrow B indicates the flow of fuel that the solenoid valve 27 sends to the pumping elements 18, and the arrow C indicates the flow of fuel that the pressure regulator 32 sends to the crankcase 33. Finally, the arrow D indicates the flow of fuel that traverses the control volume 37. The flow D coincides with the entire flowrate of the low-pressure pump 9 when the solenoid valve 27 is closed. Otherwise, it is equal to the flowrate supplied by the low-pressure pump 9 minus the flowrate required by the injectors when the solenoid valve 27 is open. Since the low-pressure pump 9 is supplied at constant voltage, it delivers an almost constant flowrate and is sized so as to deliver a flowrate always greater than the one required by the engine in the conditions of maximum load so as to guarantee a certain flowrate also for lubricating and cooling the actuation mechanism 26 of the pump 7. The flow D, passing in an area corresponding to the inlet 29 of the electromagnet 27, hence has a certain kinetic energy.

Advantageously, the ratio between the volume of the stretch 36 of the intake pipe 10 set between the inlet 29 of the solenoid valve 27 and the inlet 34 of the pressure regulator 32, i.e., the control volume 37, and the maximum volume of the intake/compression chamber 20 of each pumping element 18 is chosen between 1 and 2.

According to another characteristic of the invention, in order to facilitate the manufacture of the injection system 1 or its installation in the engine compartment of a motor vehicle, the crankcase 33 is integrated with a pump body including the cylinders 19 of the two pumping elements 18, whilst the pressure regulator 32 and the solenoid valve, or solenoid valves 27, can be incorporated in a single body separate from the body of the pump 7, and possibly be integrated with the filter 14 of the fuel, as indicated in the drawings for the variants of FIGS. 1 and 2.

From the above description, the advantages of the injection system according to the invention with respect to the known art emerge clearly. In particular, in an area corresponding to the inlet 29 of the solenoid valve 27 there is always a flow of fuel having a certain kinetic component, so that upon opening of the solenoid valve 27 the fuel does not have to start flowing from a stationary condition, and the response of the electromagnet is more prompt.

It is understood that various modifications and improvements can be made to the injection system described above, without departing from the scope of the claims. For example, a valve for adjustment 15 of the pressure in the common rail 6 can be present. In addition, in the variants of FIGS. 1 and 2 the accumulation volumes 28 of the fuel to be taken in can even be eliminated. In turn, in the variant of FIG. 3, between the solenoid valves 27 and the corresponding intake valves 25 two accumulation volumes 28 may be envisaged. In this variant, a common body can also be provided, which encloses the filter 14, the solenoid valves 27, and the pressure regulator 32, as indicated, for example, in the case of the variant of FIG. 2.

In turn, the high-pressure pump 7 can be a pump with a number of pumping elements different from two. In particular, in the case of a pump with three pumping elements, the greater promptness of intervention of the solenoid valve 27 enables a greater uniformity of filling of the intake/compression chambers 20 even in conditions of marked partialization at high engine r.p.m.

The invention claimed is:

1. A fuel-injection system for an internal-combustion engine, comprising (i) a high-pressure pump with variable flowrate, having at least one pumping element actuated with reciprocating motion through intake and delivery strokes, said pumping element being provided with an intake valve in communication with an intake pipe and a delivery valve in communication with a delivery pipe;

(ii) a metering solenoid valve arranged on said intake pipe and designed to meter the flowrate of said pump according to the operating conditions of the engine;

(iii) a pressure regulator for keeping the pressure of fuel in said intake pipe constant; and wherein said pressure regulator is set downstream of said metering solenoid valve.

2. The injection system according to claim 1, wherein said pump further comprises an actuation mechanism housed in a compartment of a crankcase, and said pressure regulator being in communication with said compartment for lubricating said mechanism.

3. The injection system according to claim 2, wherein set between an inlet of said solenoid valve and an inlet of said pressure regulator is a control volume for containing an amount of fuel such as to guarantee in an area corresponding to said inlet of the solenoid valve a flow of fuel having a pre-set flowrate or speed.

4. The injection system according to claim 3, wherein said pumping element further includes an intake chamber having a pre-set intake volume, characterized in that the ratio between said control volume and the intake volume of said chamber is between about 1 and 2.

5. The injection system according to claim 3, wherein said crankcase is integrated in a pump body, and said pressure regulator is set downstream of a filter of the fuel to be taken in, said filter, said pressure regulator, and said solenoid valve being integrated in a regulation body separate from said pump body.

6. The injection system according to claim 1, wherein said pump comprises at least two pumping elements, wherein each of said pumping elements is associated with a corresponding metering valve, said metering valves being connected on said intake pipe upstream of said pressure regulator.

7. The injection system according claim 1, wherein said pump comprises three pumping elements.

* * * * *